US005462173A

United States Patent [19]

Darling

[11] Patent Number: 5,462,173

[45] Date of Patent: Oct. 31, 1995

[54] ROTATING DRUM MAGNETIC SEPARATOR

[75] Inventor: Richard Darling, Erie, Pa.

[73] Assignee: Eriez Manufacturing Company, Erie, Pa.

[21] Appl. No.: 205,693

[22] Filed: Mar. 4, 1994

[51] Int. Cl.[6] ..... B03C 1/14

[52] U.S. Cl. ..... 209/39; 209/223.2; 209/232; 209/636

[58] Field of Search ..... 209/10, 39, 636, 209/223.1, 223.2, 232, 225, 228

[56] References Cited

U.S. PATENT DOCUMENTS 4,191,591 3/1980 Bender et al. ..... 209/232

*Primary Examiner*—Andres Kashnikow
*Assistant Examiner*—Lisa Douglas
*Attorney, Agent, or Firm*—Lovercheck and Lovercheck

[57] ABSTRACT

A magnetic separator made up of a drum bearing a plurality of stacked spaced rings each having a U-shaped cross section in the form of an arc outwardly facing channels. An upper set of magnets and a lower set of magnets supported on the separator frame and extending into the channels and matrix module are supported on the rings in spaces between the rings. A mixture of magnetic and non-magnetic material is fed onto the matrix modules and first upper nozzles spray water on the matrix modules as the matrix modules pass between the upper magnets thereby flushing non-magnetic material. The second upper nozzles spray water on the matrix modules as the modules move away from the upper magnets so that magnetic material is flushed from the matrix modules and falls into the non-magnetic hopper. The magnetic material is fed from the hopper onto the modules of the matrix material between the lower magnets and the non-magnetic residue is separated from the matrix module by the lower nozzle as the material passes between the lower magnets. The magnetic residue is washed from the matrix material as the material moves out of the fields of the lower magnets. The magnetic residue falls into a receptacle. The rings may be fabricated from fiberglass and polymer resin. The rings are clamped in spaced relation by bolts and spacers. The matrix is accordion folded sheet material.

24 Claims, 7 Drawing Sheets

ROTATING DRUM MAGNETIC SEPARATOR

BACKGROUND OF THE INVENTION

This invention relates to the field of separating apparatus, and particularly to apparatus for separating weakly magnetic particles from the non-magnetic particles of a mixture of the two. Here, the word "magnetic" refers to particles which are magnetically susceptible, and is not meant to imply particles which are themselves permanently magnetized. The procedure is very important in modern iron mining operations, where the ore is of relatively low grade and contains much gangue. An example is the operation of taconite mining where the ores are of relatively low grade, contain primarily weakly magnetic iron minerals, and are commonly referred to as "oxidized taconite". Such ores are generally no better than the discarded "tailings" of earlier iron mining operations, and indeed those tailings may become a valuable source of iron by the use of the separator of the present invention.

Applicant is aware of the following U.S. Pat. Nos. 3,947,349 and 4,046,680 to Fritz which both show permanent magnet high intensity separators; and 4,874,508 to Fritz which shows a magnetic separator.

STATEMENT OF THE INVENTION

The rotating drum assembly of the magnetic separator disclosed herein is composed of a number of stacked identical "ring" units, which together form the center section. At each end of the center section stack, there is a transition ring, that, except for flange diameters, is identical to the ring units in the center section. The transition rings bolt, in turn, at their outer ends, to drum support rings, that are designed to carry torque and bending loads necessary to position the drum in space and to rotate it.

The center section rings are spaced apart in the stack by a dimension sufficient to allow modules of a porous matrix material to be inserted between the flanges of adjacent rings. Process material is passed through this matrix to effect a magnetic separation. The spacing between the rings is necessary to allow material being processed to be passed from external nozzles into the interior of the drum, and from internal nozzles back to the exterior, via the porous matrix modules.

The solution to many problems of prior separators is the stacked-ring-with-offset-bolt design described herein. The drum is an assembly of rings, each with a U-shaped cross section, connected together by bolts near to but offset from the inner drum surface, and passing through spacers which determine the width (axially) of the matrix pockets. The matrix pockets are formed between every two adjacent rings. By offsetting the bolts outward from the inner surface of the drum, it is possible to insert feed nozzles directly into the matrix pockets from the drum interior. By incorporating the spacers, through which the bolts pass, into the inner ends of the partitions which define the radially oriented boundaries of the matrix pockets, the double purpose of minimizing flow disruption and attaching these partitions is achieved. By letting tabs, or rods, at the outer ends of the partitions engage holes in the facing surfaces of the two adjacent rings, the partitions are stabilized in a radial orientation.

The stacked rings that comprise the rotating drum design are manufactured as unitary structures formed of many layers of fiberglass and polymer resin. The rings are U-shaped in cross section, with the open side of the "U" facing outward. The fiber direction and wall thickness in each region of a ring cross section is optimized for load-carrying capability and minimum weight. The construction method produces highly repeatable parts within small tolerances, and with an ideally smooth surface exposed to process material flow. Also, the composite material is resistant to corrosion. Individual rings are lightweight and easy to handle during assembly and when removal is required for maintenance. The use of the composite rings reduces the structure weight substantially, relative to typical steel construction. Because of this weight reduction, the "stacked ring" structure, with offset connecting bolts becomes practical. If constructed in steel, the additional weight would increase the cantilever loads near the offset bolts in the center of the drum to the extent that the bolt offset would have to be substantially reduced or the overall drum would have to be reduced. If the bolt offset were reduced, the stacked ring with offset bolt design would inherit many of the disadvantages of the prior art design, primarily those that produce interference with flow patterns and/or material wear.

Each of the unitary rings shown in the drawings could consist of two to several identical arc-shaped segments. By staggering (along the length of the drum) the end joints between these segments, an appropriate number of segments could be assembled to function essentially identically to a corresponding number of complete rings. This construction technique could be applied whether the individual segments were of composite material or steel. Among the advantages would be lower cost of part fabrication, ease of part handling, and the ability to remove individual arc-segments in the field for maintenance, without having to disassemble the entire drum.

To retain the matrix modules within the pockets formed for them between successive rings, a circumferential ledge of wear resistant material is provided at the outer edge of the facing surfaces of each ring flange. This ledge additionally protects the only ring surface that is directly exposed to the full abrasive force of the feed flow. (After entering the matrix, the feed velocity is greatly attenuated, and after passing through the first set of matrix, the feed is greatly dispersed and fractionated, thus reducing further abrasive effects.)

The matrix material may consist of an accordion-folded sheet, with the creases oriented circumferentially in the matrix pockets. The natural springing action of the folds causes the matrix to expand and to be retained in the pockets by interference between the outermost folds and the abrasion-resistant ledge. Conversely, by simple compression with a pair of pliers, or the like, the entire matrix module can be reduced in thickness enough to clear the ledge, and the matrix module can be withdrawn easily from the pocket. Also, matrix modules can easily be compressed enough to pass between the ledges as they are inserted into the pockets. They then expand naturally to remain trapped in the pockets.

SUMMARY OF THE INVENTION

It is an object of the present invention to provide an improved magnetic separator.

It is another object of the present invention to provide a rotary magnetic separator that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
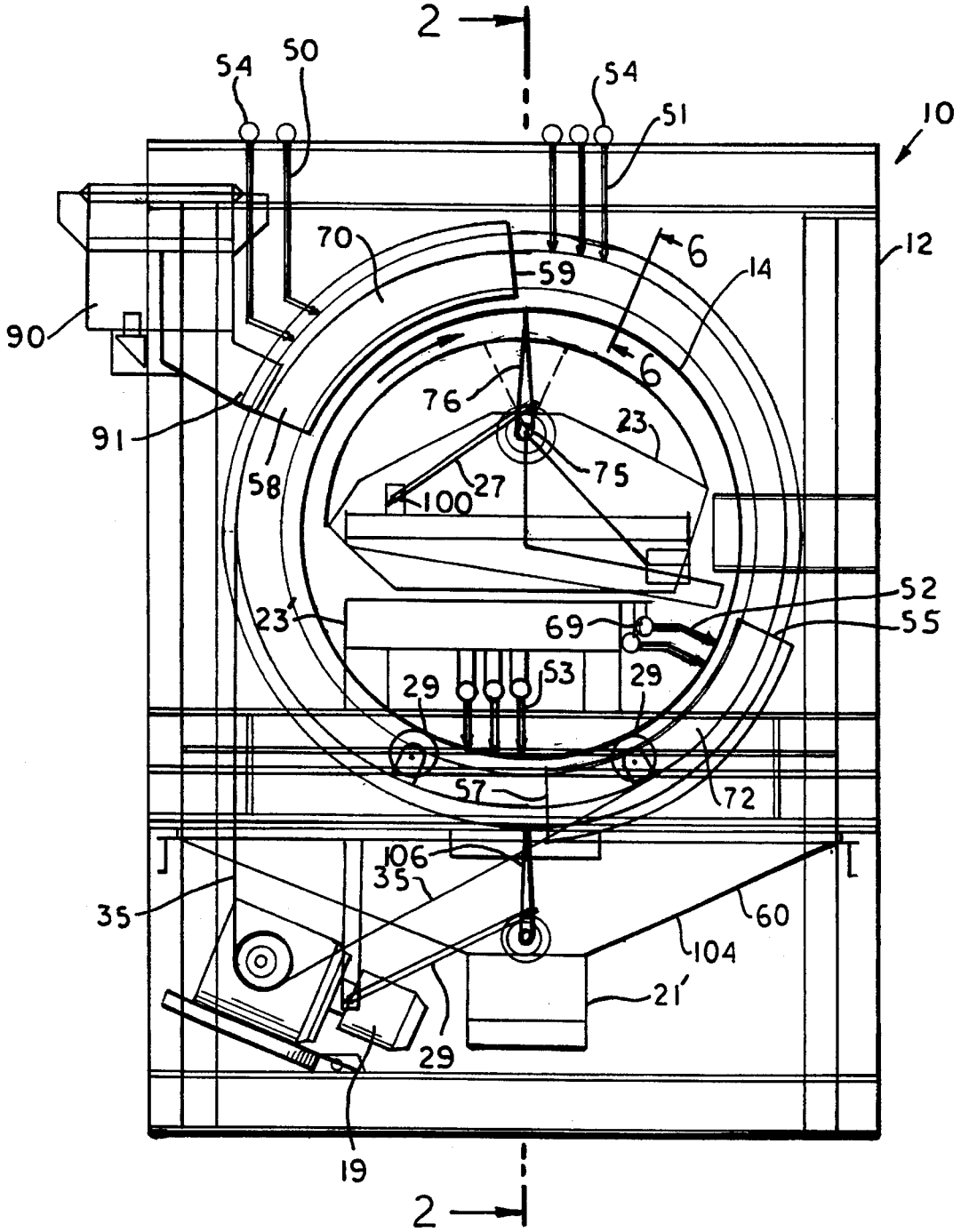
FIG. 1 is an end view of the magnetic separator according to the invention.
Figure 2:
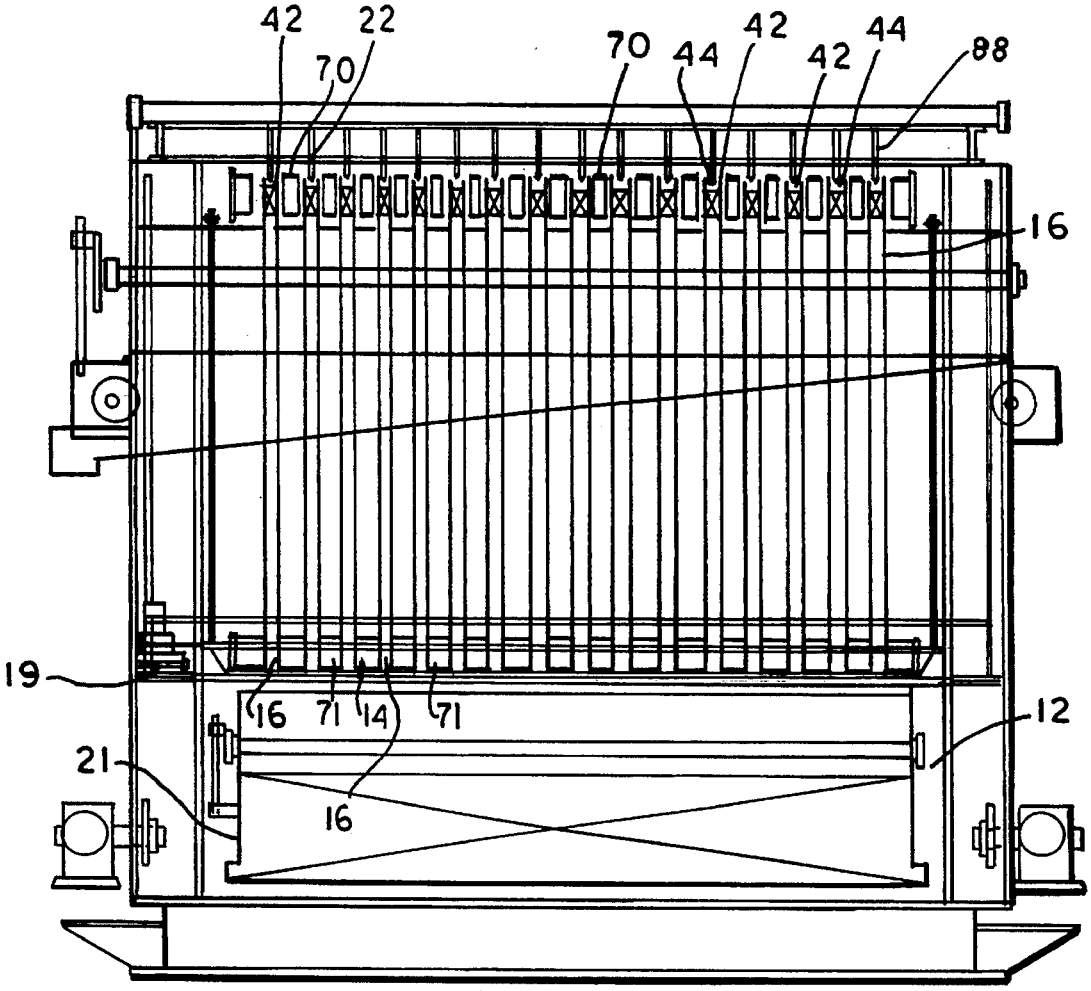
FIG. 2 is a cross sectional view of the separator taken on line 2—2 of FIG. 1.
Figure 3:
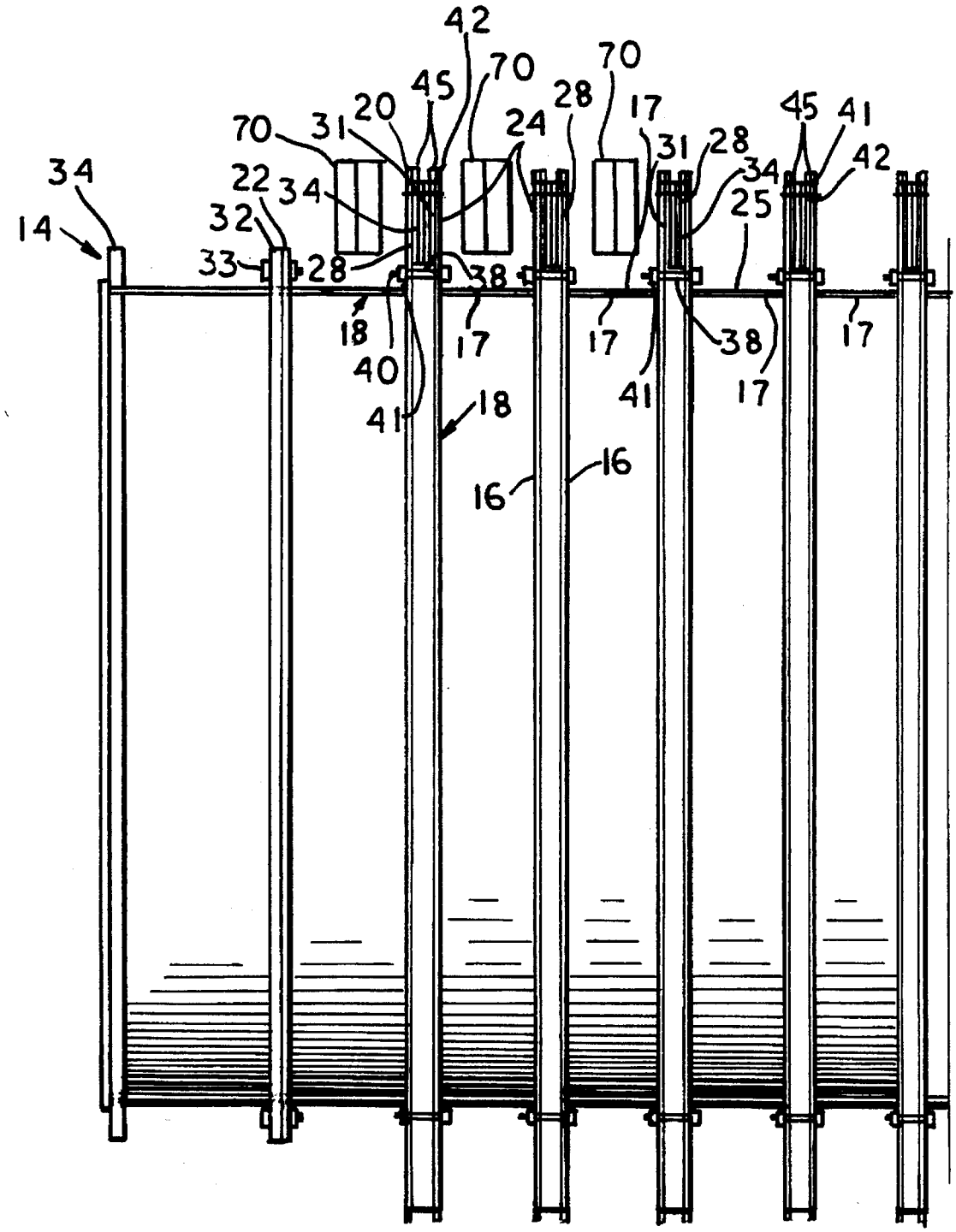
FIG. 3 is a side view of the drum of the magnetic separator according to the invention.
Figure 4:
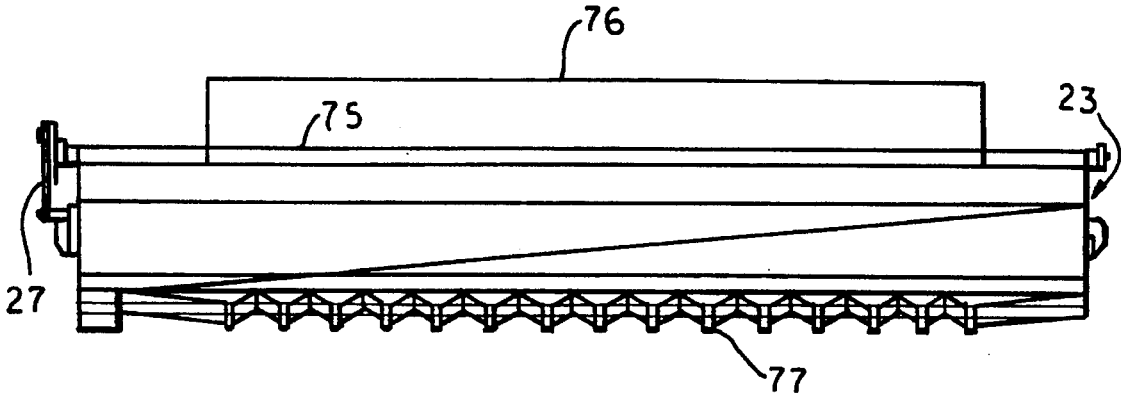
FIG. 4 is an enlarged partial view of the center hopper.
Figure 5:
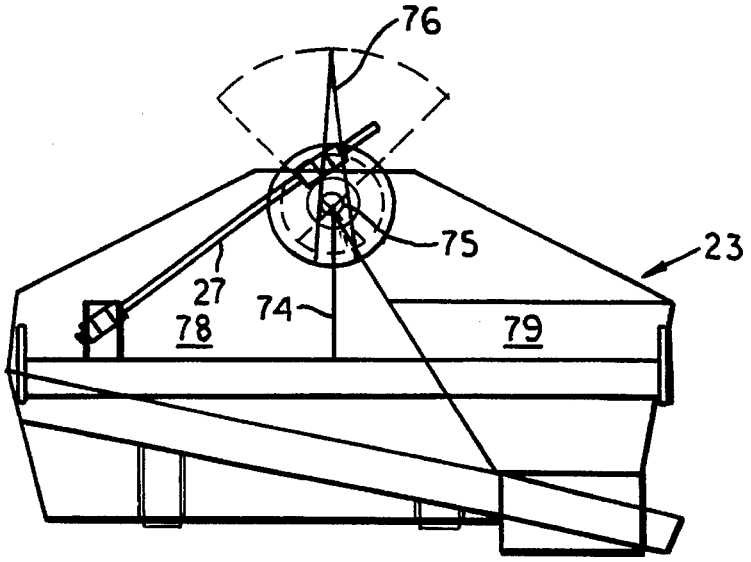
FIG. 5 is an end view of the center hopper.
Figure 6:
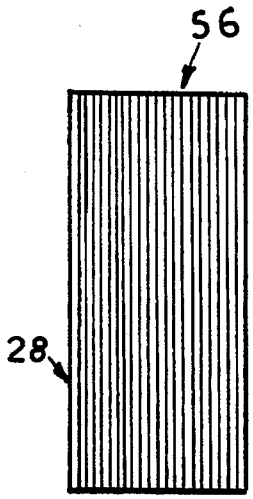
FIG. 6 is an enlarged end view of the matrix module.

Now with more particular reference to the drawings, shown is magnetic separator 10 having drum 14 supported on frame 12, which may be a support means.

Drum 14 is made up of a stack of several intermediate rings 16. Each intermediate ring 16 is U-shaped in cross section and may be made of fiberglass impotted in resin. Each intermediate ring 16 comprises an annular outwardly facing channel 17. Outwardly facing channel 17 has annular bottom 25 and two spaced annular flanges 24 that are fixed to annular bottom 25 and extend outwardly therefrom. Intermediate ring 16 at each end of the stack of intermediate rings 16 has transition ring 18 fixed to one of the flanges.

Each transition ring 18 has annular bottom 21 and long flange 20 attached to one of spaced flanges 24 of intermediate ring 16 and short flange 22 attached to flange 32 of support ring 30 by bolts 33. Support rings 30 are each fixed to transition ring 18. Support ring 30 supports drum 14 on rollers 29 which are attached to frame 12. Chain or belt 35 extends around support rings 30 and belt 35 is driven by motor 19.

Center hopper 23 is located inside drum 14 and supported on frame 12. Center hopper 23 has longitudinally extending partition 74 and adjustable splitter 76. Splitter 76 is supported on shaft 75 and extends upwardly between non-magnetic receptacle 78 and magnetic receptacle 79 and splitter 76 divides magnetic material from non-magnetic material as the materials fall from matrix modules 28. Splitter 76 can be adjustable inclined by arm 27 to incline splitter 76 toward or away from magnet 70.

Figure 7:
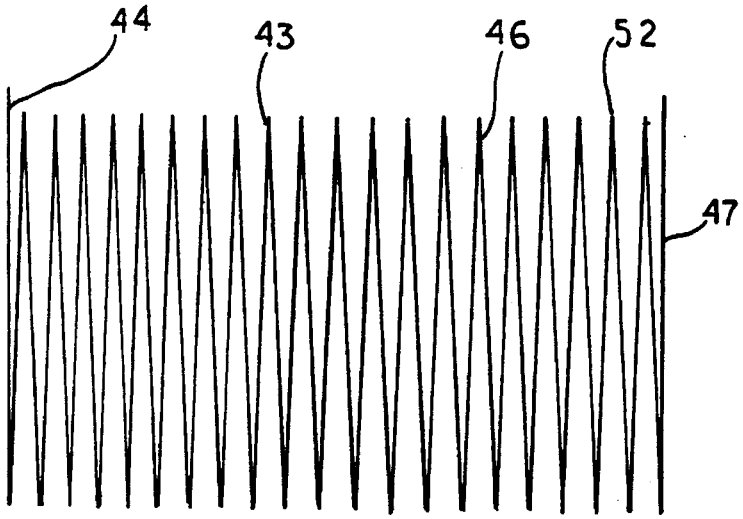
FIG. 7 is an enlarged expanded view of a matrix module.
Figure 8:
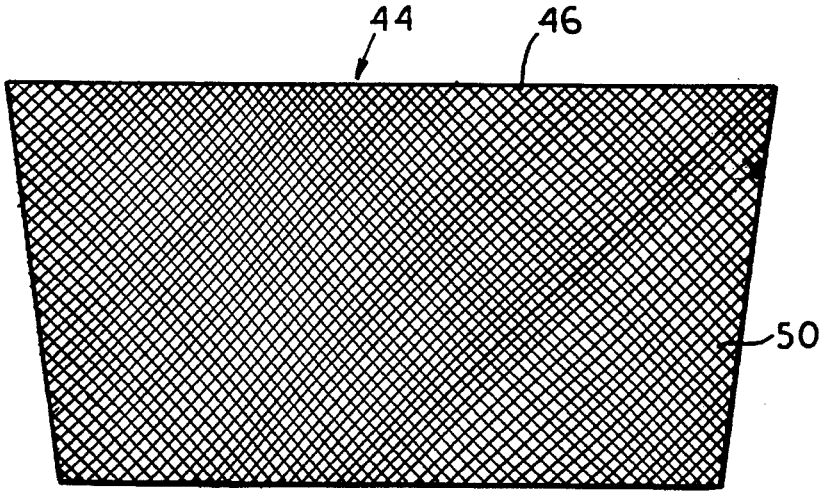
FIG. 8 is a view of a perforated sheet used in a matrix module.

Matrix modules 28 act as an entrapping means for magnetic material. Matrix modules 28 are each made up of accordion-like folded sheet 44 of resilient magnetic material. The natural spring action of sheets 44 cause matrix modules 28 to expand and to be retained in pockets 31 between bolts 40 and pins 42. When compressed, sheets 44 form blocks 56, as shown in FIG. 7. Blocks 56 are substantially rectangular in the side view. Sheet 44, having closely spaced openings 46, allow process material to pass through to center hopper 23. Sheets 44 form panels 47 with creases 43. Panels 47 can be compressed to be generally parallel to one another and to reduce the lateral dimension of matrix modules 28 so that matrix modules 28 can be easily slipped past ledges 45. Other forms of entrapment means to retain magnetic material could be used in pockets 31. For example, coarse steel wool, screen wire or perforated steel could be used to form matrix modules 28.

Tubular spacers 38 are located between rings 16 and hold rings 16 in axially spaced relation to one another, providing open bottom space 34 between each two adjacent rings 16. Bolts 40 extend through flanges 24 of adjacent rings 16 and extend through tubular spacers 38 clamping rings 16 together spacers 38 are disposed in spaces 34. Bolts 40 have nuts 41 that hold flanges 24 to spacers 38. Spaces 34, radially outward of bolts 40, are divided into pockets 31 by partitions 49 supported on threaded pins 42. Pockets 31 are formed in each space 34 between each two adjacent intermediate rings 16. Bolts 40 support the lower edge of partition 49. Pins 42 threadably engage nuts 41.

Ledges 45, may be flat rings made of abrasion resistant material, such as urethane, adhered to the outer peripheral edges of flanges 24 by suitable resin and overlie the outer edges of matrix modules 28. Ledges 45 retain matrix modules 28 in pockets 31.

Permanent magnets 70 are supported on frame 12 and extend downward into channels 17. Magnets 70 have poles unlike the poles of adjacent magnets 70 in adjacent channels 17. Consequently, magnetic flux from magnets 70 extend through matrix modules 28 as matrix modules 28 are moved through the magnetic flux. Lower magnets 72 are supported on frame 12 and extend upwardly into outwardly facing channels 17.

First upper nozzles 50 direct water onto matrix modules 28 along upstream end 58 of upper magnets 70. Second upper nozzles 51 direct water onto matrix modules 28 beyond the downstream end 59 of upper magnets 70. Longitudinally extending upper water headers 54 extend above the top of drum 14 to first upper nozzles 50 and to second upper nozzles 51.

First lower nozzles 52, connected to lower water header 69, direct water onto matrix modules 28 adjacent upstream end 55 of lower magnets 72 to wash non-magnetic material from matrix modules 28 into lower hopper 60. Lower hopper 60 has sides 104 and discharge chute 21. Second lower nozzles 53 supported on frame member 23' directs water onto matrix modules 28 beyond downstream end 57 of lower magnets 72.

Feed box 90 is supported above drum 14. Chutes 91 are connected to feed box 90 and direct the material to be separated onto matrix modules 28. Magnetic process material is flushed through matrix module 28 at the lower part of drum 14 and any residual magnetic material is separated by lower magnets 72 and falls into lower hopper 60. Lower hopper 60 has sides 104. Splitter 106 is supported adjacent downstream end 57 of lower magnet 72. Separated material is discharged through chute 21.

Figure 9:
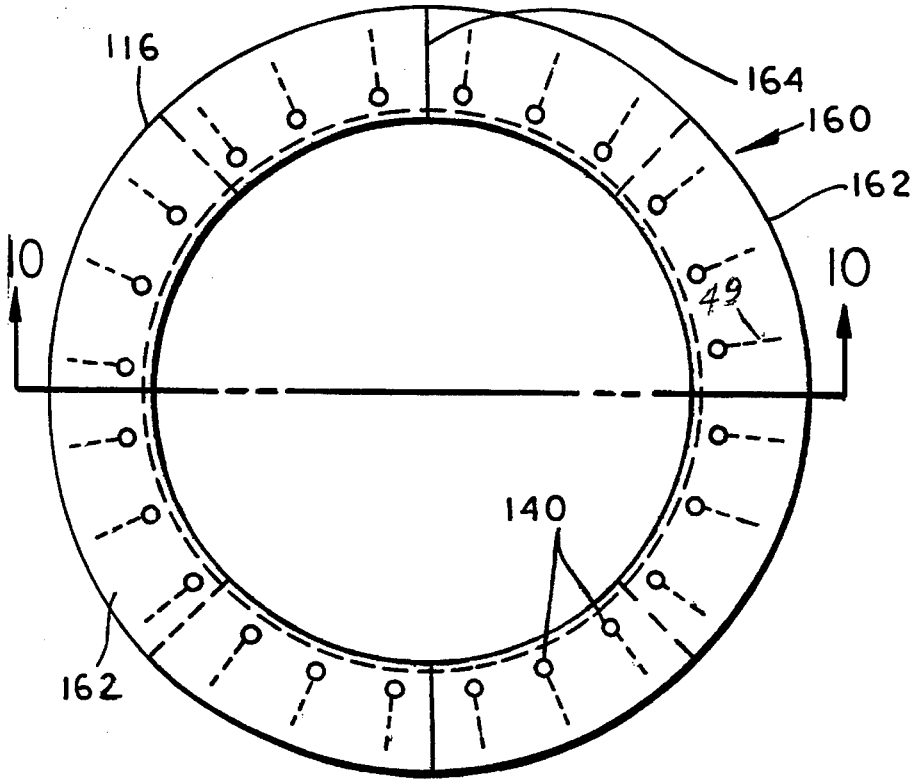
FIG. 9 is a side view of another embodiment of the drum.
Figure 10:
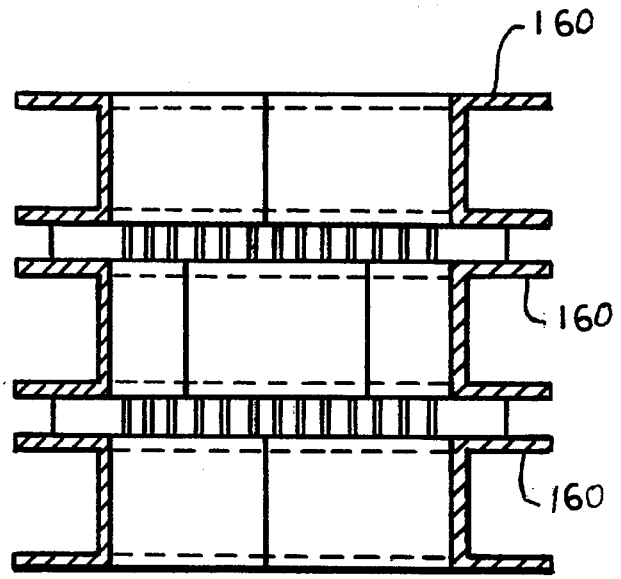
FIG. 10 is a cross sectional view of the intermediate ring taken on line 10—10 of FIG. 9.
Figure 11:
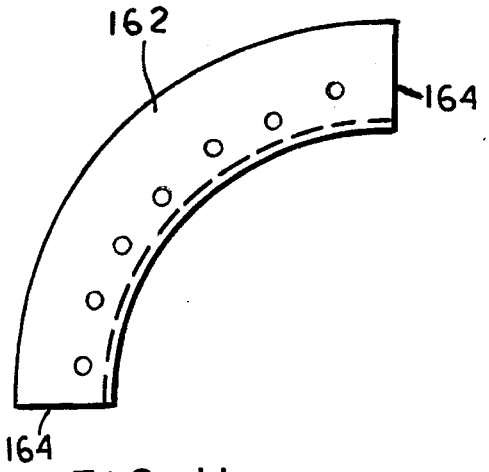
FIG. 11 is a side view of one of the segments shown in FIG. 9.
Figure 13:
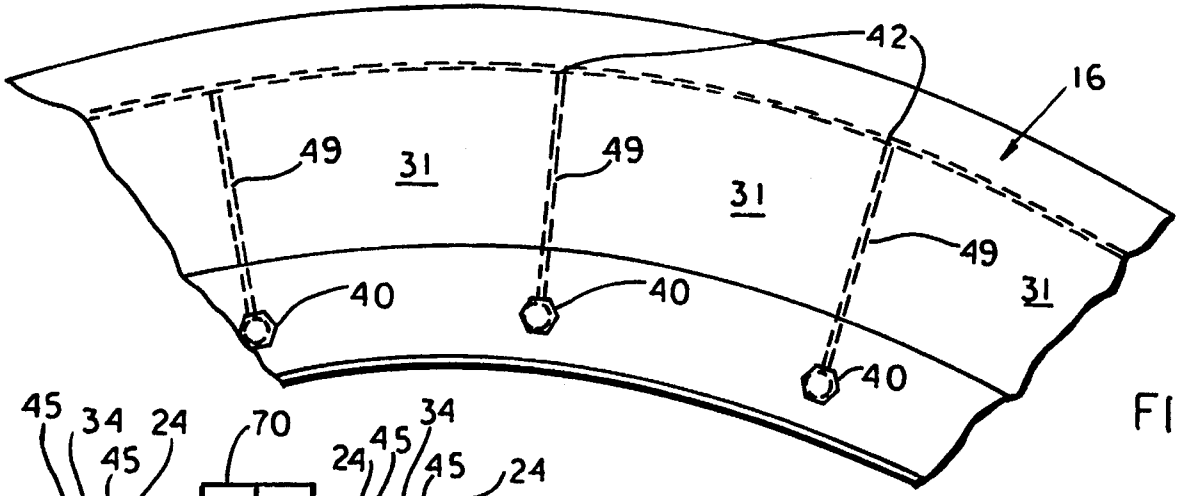
FIG. 13 is a side view of FIG. 12.
Figure 12:
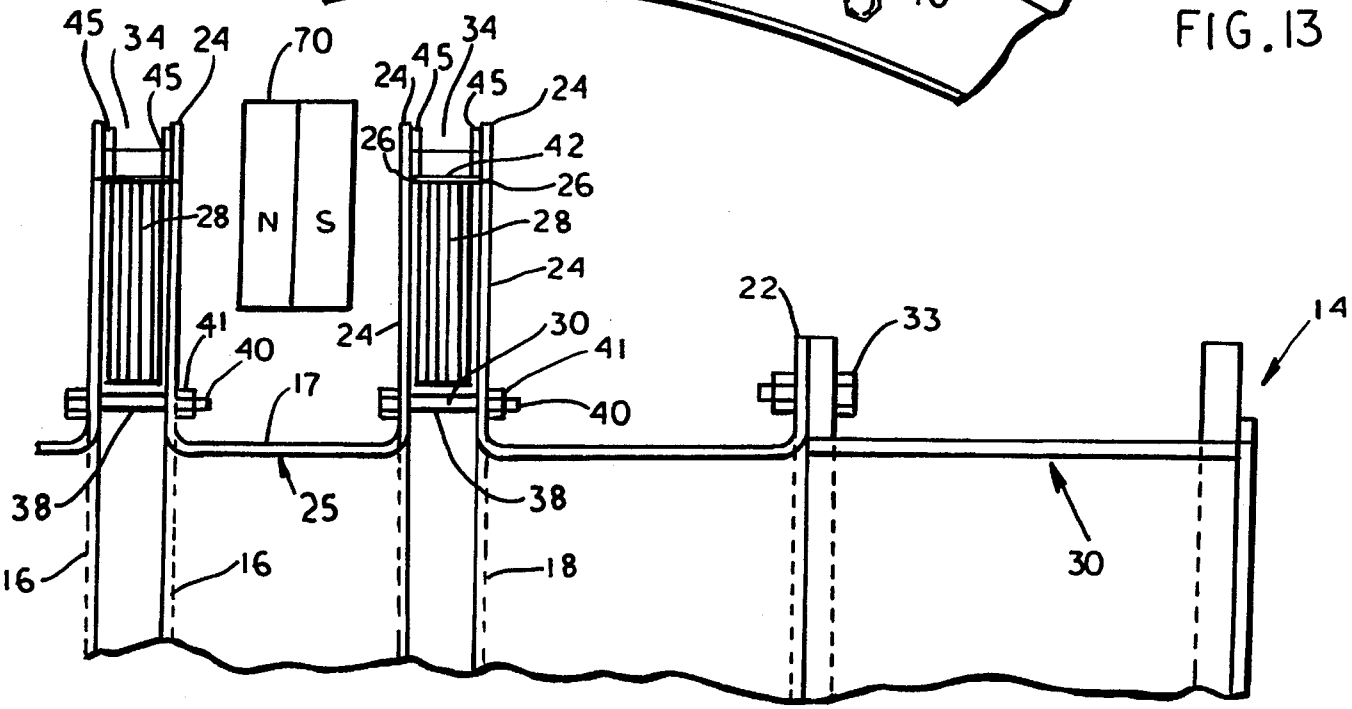
FIG. 12 is an enlarged partial view of FIG. 3.

In the embodiment of the drum shown in FIGS. 9, 10 and 11, intermediate rings 160 are made of four 90° arc shaped segments 162, each segment spans about 90° of arc of intermediate ring 160. By staggering ends 164 of adjacent segments 162 and by using multiple segments per intermediate ring 160, intermediate rings 160 can function almost identically to intermediate rings each made of one integral channel. Each segment 162 has ends 164. Bolts are received in holes 140 holding intermediate rings 160 together as shown in the other embodiments of the invention. Ends 164 of each segment 162 may be disposed in end-to-end relation to one another or spaced from one another. Segments 162 may be used in multiple layers if desired and each segment 162 could span 90, degrees, 180 degrees, 120 degrees, or other arc lengths, for example. Care should be taken in assembly of segments 162 to insure that the breaks between segments 162 are staggered so that the breaks are distributed uniformly around the drum and the breaks between the segments in adjacent intermediate rings 160 should not be in alignment with one another.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A magnetic separator comprising a support means;

a drum supported on said support means;

said drum comprising a stack of spaced rings;

said rings each comprising an outwardly facing channel extending continuously around each said ring;

said outwardly facing channels each being defined by an annular bottom and two spaced flanges fixed to said annular bottom;

said outwardly facing channels extend outwardly from said drum;

spacer means engages said flanges holding said outwardly facing channels in spaced relation to one another defining spaces between two said rings;

entrapping means, made of magnetic material, disposed in said spaces between said rings;

magnets supported on said support means;

said magnets being disposed in said outwardly facing channels and adapted to direct a magnetic field through said entrapping means;

drive means connected to said rings to rotate said drum and to bring each said entrapping means successively through said magnetic field from said magnets;

a center hopper in said drum is supported on said support means;

said center hopper having axially extending partition means dividing said center hopper into a magnetic section and a non-magnetic section;

feed means supported on said support means above said drum to feed a mixture of magnetic material and non-magnetic material onto said entrapping means;

said non-magnetic section of said center hopper being disposed below said magnets to receive said non-magnetic material; and, said magnetic section being disposed in spaced relation to said magnets to receive magnetic material.

2. The magnetic separator recited in claim 1 wherein said support means is a frame and said rings are made of fiberglass.

3. The magnetic separator recited in claim 1 wherein said intermediate rings are each made up of arcuate segments of channels.

4. The magnetic separator recited in claim 1 wherein said entrapping means comprises matrix modules made of sheets of resilient magnetic material bent accordion-like.

5. The magnetic separator recited in claim 4 wherein said spacer means are held in engagement with said flanges by bolts extending through said flanges on said rings and through said spacers holding said outwardly facing channels against said flanges.

6. A magnetic separator comprising a support means;

a drum supported on said support means;

said drum comprising a plurality of rings;

said rings each comprising an outwardly facing channel extending continuously around each said ring;

said outwardly facing channels each being defined by an annular bottom and two spaced flanges fixed to said annular bottom;

spacer means engaging said flanges holding said outwardly facing channels in spaced relation to one another defining spaces between said rings;

entrapping means comprised of matrix modules made of magnetic material supported on said drum and disposed in said spaces between said rings;

magnets supported on said support means;

said magnets being disposed in said outwardly facing channels and adapted to direct a magnetic field through said entrapping means;

drive means connected to said drum to rotate said drum and to bring each said entrapping means successively through said magnetic fields from said magnets;

a center hopper in said drum supported on said support means;

said center hopper having axially extending partition means dividing said center hopper into a magnetic section and a non-magnetic section;

feed means supported on said support means above said drum to feed a mixture of magnetic material and non-magnetic material onto said entrapping means;

said non-magnetic section of said center hopper being disposed below said magnets to receive said non-magnetic material;

said magnetic section being disposed in spaced relation to said magnets to receive magnetic material;

said spacer means comprise tubular members;

said flanges resting on the ends of said tubular members;

bolts extending through said flanges and said tubular members;

said bolts being offset radially outwardly from said annular bottom of said outwardly facing channels and extend through said flanges and are held by nuts on said bolts.

7. The magnetic separator recited in claim 6 wherein a plurality of first upper nozzles are supported on said support means above said drum;

said first upper nozzles each being disposed to direct water onto said matrix modules between said magnets as said matrix modules pass through said magnetic field whereby non-magnetic material is flushed from said matrix modules;

second upper nozzles supported on said support means and adapted to direct water onto said matrix modules as said matrix modules move away from said magnets whereby magnetic material is flushed from said matrix modules into said magnetic section of said center hopper.

8. The magnetic separator recited in claim 7 wherein lower magnets are supported on said support means and extend into said outwardly facing channels of said rings;

first lower nozzles supported on said support means inside said drum to direct water onto said matrix modules as said matrix modules move between said lower magnets; and, a lower hopper supported on said support means to receive said magnetic material from said matrix modules.

9. The magnetic separator recited in claim 6 wherein said rings are made of fiberglass impregnated with polymer resins.

10. The magnetic separator recited in claim 1 wherein said entrapping means comprises matrix modules comprising accordion-like folded sheets, wherein said matrix modules being adapted to expand into the form of generally rectangular blocks with said blocks having a width substantially equal to the width of said spaces between said flanges and received in said spaces and ledge means on said flanges overlying said modules retaining said modules in said spaces.

11. The magnetic operator recited in claim 10 wherein said sheet incorporates closely spaced relatively small openings.

12. The magnetic separator recited in claim 6 wherein said feed means comprises a feed box;

said feed box having a plurality of outlets;

said outlets being located to direct process material onto each of said matrix modules at a position adjacent an upstream end of said magnets.

13. The magnetic separator recited in claim 6 wherein a plurality of lower magnets are supported on said support means below said drum;

said lower magnets extend into said outwardly facing channels in each said ring.

14. The magnetic separator recited in claim 13 wherein a plurality of lower spray nozzles are supported on said support means and disposed inside said drum to direct a water spray onto said matrix modules adjacent said lower magnet for washing said non-magnetic material from said matrix modules.

15. The magnetic separator recited in claim 7 wherein said upper first nozzles are connected to an upper header means disposed above said drum and supported on said support means.

16. The magnetic separator recited in claim 14 wherein said lower spray nozzles are connected to a lower header disposed inside said drum.

17. A magnetic separator comprising a support means;

a drum comprising a plurality of spaced intermediate rings rotatably supported in said support means;

some of said rings comprising annular outwardly facing channels each having a bottom and spaced flanges;

spacer means attached to said flanges holding said rings in spaced relation to each other defining annular spaces between said rings;

circumferentially spaced, radially extending partitions in said annular spaces attached to said spaced flanges and dividing said annular spaces into pockets;

matrix modules disposed in said pockets;

a plurality of magnets supported on said support means;

at least one of said magnets extending into each said outwardly facing channel providing a magnetic field;

said magnetic fields extending through said matrix modules;

feed means to feed a mixture of non-magnetic materials and magnetic materials to said matrix modules;

drive means connected to said rings for rotating said drum;

a first receptacle for non-magnetic material below said magnets and a second receptacle for magnetic material spaced from said magnets.

18. A magnetic separator comprising a support means;

a drum comprising a plurality of rings rotatably supported on said support means;

said drum consisting of a plurality of rings;

said rings comprising annular outwardly facing channels each having a bottom and spaced flanges;

drive means connected to said rings for rotating said drum; spacer means disposed between said flanges adjacent said rings attached to said flanges holding said rings in spaced relation to each other providing an annular open bottom space between each of said two adjacent rings;

said annular spaces being divided into pockets;

said pockets being defined by circumferentially spaced radially extending partitions;

said partitions having ends;

said ends of said partitions being supported on said spaced flanges;

matrix modules in said pockets;

magnets supported on said support means and extending into said channels;

feed means to feed a mixture of magnetic and non-magnetic material to said matrix modules between said magnets; and, a hopper for magnetic material below said magnets.

19. The magnetic separator recited in claim 17 wherein each said flange has a ledge fixed thereto;

each said matrix module comprises a sheet of resilient material accordion folded and pressed into a said pocket and held in place by said ledges fixed to the outer periphery of one of said rings.

20. The magnetic separator recited in claim 19 wherein each said sheet is folded into a plurality of sections disposed generally parallel to each other when pressed into the form of a block;

said sections being generally parallel to one another when said matrix modules are inserted in said pockets.

21. The magnetic separator recited in claim 19 wherein said ledges are made of an abrasion resistent material;

said ledges providing a stop holding said matrix modules in said pockets.

22. The magnetic separator recited in claim 21 wherein said matrix modules are made of a magnetic material.

23. The magnetic separator recited in claim 22 wherein said matrix modules have closely spaced openings therein.

24. The magnetic separator recited in claim 1 wherein said rings are each made up of several arcuate channel shaped segments and support means holding said segments in the general form of rings with the ends of said segments each being disposed adjacent the end of another said segment.

* * * * *